US008695487B2

(12) United States Patent
Sakane et al.

(10) Patent No.: US 8,695,487 B2
(45) Date of Patent: Apr. 15, 2014

(54) COOKING APPLIANCE

(75) Inventors: Yasuaki Sakane, Osaka (JP); Toshiaki Ueki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 250 days.

(21) Appl. No.: 13/259,044

(22) PCT Filed: Apr. 13, 2010

(86) PCT No.: PCT/JP2010/056583

§ 371 (c)(1),
(2), (4) Date: Sep. 22, 2011

(87) PCT Pub. No.: WO2010/119862

PCT Pub. Date: Oct. 21, 2010

(65) Prior Publication Data

US 2012/0017770 A1 Jan. 26, 2012

(30) Foreign Application Priority Data

Apr. 16, 2009 (JP) ..... 2009-099993
Apr. 1, 2010 (JP) ..... 2010-085322

(51) Int. Cl.
*A47J 27/04* (2006.01)
*H05B 6/64* (2006.01)
*A21B 1/00* (2006.01)

(52) U.S. Cl.
USPC ..... 99/331; 99/338; 99/467; 126/369; 126/369.1; 219/682; 219/401

(58) Field of Classification Search
USPC ..... 99/331, 337, 338, 281, 288, 467, 473, 99/474, 476; 219/401, 682; 126/369, 126/369.1
See application file for complete search history.

(56) References Cited

U.S. PATENT DOCUMENTS

| | | | | |
|---|---|---|---|---|
| 6,323,464 | B1 * | 11/2001 | Cohn | 219/401 |
| 6,832,732 | B2 * | 12/2004 | Burkett et al. | 236/44 C |
| 8,171,843 | B1 * | 5/2012 | Heffington | 99/282 |
| 2003/0230569 | A1 | 12/2003 | Kanzaki et al. | |
| 2005/0145622 | A1 | 7/2005 | Sano et al. | |
| 2007/0029313 | A1 * | 2/2007 | Kanzaki et al. | 219/682 |

FOREIGN PATENT DOCUMENTS

| | | | |
|---|---|---|---|
| JP | 6-185738 | A | 7/1994 |
| JP | 2003-74865 | A | 3/2003 |
| JP | 2004-11995 | A | 1/2004 |
| JP | 2004-20005 | A | 1/2004 |
| JP | 2004-61011 | A | 2/2004 |
| JP | 2009-41822 | A | 2/2009 |

* cited by examiner

*Primary Examiner* — Reginald L Alexander
(74) *Attorney, Agent, or Firm* — Birch, Stewart, Kolasch & Birch, LLP

(57) ABSTRACT

Disclosed is a cooking appliance provided with: a water tank (30) disposed inside a main case (10); a steam-generation device (40) that generates steam by heating water supplied from the water tank (30); a heating chamber (20) to which steam from the steam-generation device (40) is supplied; an exhaust duct (72), provided inside the main case (10), for expelling exhaust from inside the heating chamber (20) to outside the main case (10); an exhaust temperature sensor (74) that measures the temperature of the exhaust air inside the exhaust duct (72); and a steam-generation decision unit that, upon cooking in which steam is supplied from the steam-generation unit (40) into the heating chamber (20), uses information on a physical quantity (the exhaust temperature measured by the exhaust temperature sensor (74)), which indirectly indicates whether there is water in the steam-generation device (40), to decide whether or not to halt steam generation, including the case in which the water tank (30) is out of water.

4 Claims, 8 Drawing Sheets

*Fig.9*

| | | (1) | | | (2) | | | (3) | | |
|---|---|---|---|---|---|---|---|---|---|---|
| STATUS | | COOLED, NO WATER | | | COOLED, NO WATER | | | WARMED, WATER PRESENT | | |
| SUPPLY WATER | | SUPPLY WATER PRESENT | | | SUPPLY WATER ABSENT | | | SUPPLY WATER ABSENT | | |
| ELAPSED TIME | | MIN, SEC | SEC | ON/OFF TIME | MIN, SEC | SEC | ON/OFF TIME | MIN, SEC | SEC | ON/OFF TIME |
| $1^{ST}$-TIME | ON | 0 | | 37 | 0 | | 37 | 0 | | 49 |
| | OFF | 37 | 37 | 12 | 37 | 37 | 12 | 49 | 49 | 24 |
| | | 49 | 49 | | 49 | 49 | | 1 13 | 73 | |
| $2^{ND}$-TIME | ON | 59 | 59 | 10 | 58 | 58 | 9 | 1 19 | 79 | 6 |
| | OFF | 1 11 | 71 | 12 | 1 16 | 76 | 18 | 1 45 | 105 | 26 |
| $3^{RD}$-TIME | ON | 3 10 | 190 | 119 | 1 23 | 83 | 7 | 1 51 | 111 | 6 |
| | OFF | 3 15 | 195 | 5 | 1 45 | 105 | 22 | 2 27 | 147 | 36 |
| $4^{TH}$-TIME | ON | 4 2 | 242 | 47 | 1 51 | 111 | 6 | 2 32 | 152 | 5 |
| | OFF | 4 7 | 247 | 5 | 2 16 | 136 | 25 | 3 11 | 191 | 39 |
| $5^{TH}$-TIME | ON | 4 49 | 289 | 42 | 2 22 | 142 | 6 | 3 15 | 195 | 4 |
| | OFF | 4 56 | 296 | 7 | 2 54 | 174 | 32 | 3 57 | 237 | 42 |
| $6^{TH}$-TIME | ON | 5 33 | 333 | 37 | 3 0 | 180 | 6 | 4 3 | 243 | 6 |
| | OFF | 5 39 | 339 | 6 | 3 39 | 219 | 39 | 4 48 | 288 | 45 |
| $7^{TH}$-TIME | ON | | | | WATER EMPTINESS DETECTED | | | WATER EMPTINESS DETECTED | | |
| | OFF | | | | | | | | | |
| $8^{TH}$-TIME | ON | | | | | | | | | |
| | OFF | | | | | | | | | |
| | ON | | | | | | | | | |

COOKING APPLIANCE

TECHNICAL FIELD

The present invention relates to a cooking appliance.

BACKGROUND ART

In some types of conventional cooking appliances, water supplied from within a water tank is heated by a steam generation device to generate steam, and the generated steam is supplied to a heating chamber (see, e.g., JP 2009-41822 A (PTL 1)).

This type of cooking appliance includes a water level sensor with a plurality of different-in-length electrodes combined together. By detecting which ones among the detection-use electrodes of the water level sensor are submerged in water, a water level within the water tank is detected, where with none of the detection-use electrodes submerged in water, it is decided that no water is present.

However, this cooking appliance has a problem that the cost increases because of a complicated structure of the water level sensor. In this cooking appliance, a space for the water level sensor is necessitated in proximity to the water tank causing the unit size to increase, while with the unit size unchanged, causing the water tank size to decrease due to the space for water level sensor resulting in decreasing the water tank capacity.

Moreover, in this cooking appliance, when the steam generation device stops steam generation due to factors (heater fault or pump fault) other than emptiness of water in the water tank, it is impossible for the water level sensor to detect the factors.

CITATION LIST

Patent Literature

PTL1: JP 2009-41822 A

SUMMARY OF INVENTION

Technical Problem

Accordingly, an object of the present invention is to provide a cooking appliance capable of detecting a halt of steam generation function, including emptiness of water, with a simple configuration without any water level sensor and therefore cutting down the device cost.

Solution to Problem

In order to achieve the above object, the present invention provides a cooking appliance comprising:

a main casing;

a water tank placed within the main casing;

a steam generation device which has a steam generation container supplied with water from the water tank, and a steam generation heater for heating water in the steam generation container, and which serves for heating water supplied from the water tank to generate steam;

a heating chamber to which steam from the steam generation device is supplied;

a steam-generation-container temperature sensor for detecting a temperature of the steam generation container;

a steam-generation-heater control part which, in cooking in which steam from the steam generation device is supplied into the heating chamber, with supply of water from the water tank to the steam generation container, repeats turn-on and -off of the steam generation heater by controlling the steam generation heater so that a temperature of the steam generation container detected by the steam-generation-container temperature sensor falls within a target temperature range; and a steam-generation-function decision unit for, based on a ratio of OFF- time to ON-time in ON/OFF operation of the steam generation heater, deciding whether or not it is a halt of steam generation function including emptiness of water in the water tank, in cooking in which steam from the steam generation device is supplied into the heating chamber, wherein when the ratio of OFF-time to ON-time in ON/OFF operation of the steam generation heater is larger than a specified value, the steam-generation-function decision unit decides that it is a halt of the steam generation function including emptiness of water in the water tank.

According to this embodiment, in cooking (e.g., oven cooking, steam cooking, etc.) in which steam from the steam generation device is supplied into the heating chamber, steam from the steam generation device is supplied to the heating chamber. Also, in cooking in which steam from the steam generation device is supplied into the heating chamber, the steam-generation-heater control part controls the steam generation heater so as to repeat turn-on and -off of the steam generation heater based on a temperature of the steam generation container detected by the steam-generation container temperature sensor. By this control, the temperature of the steam generation container is brought to within a target temperature range. Then, upon occurrence of emptiness of water in the water tank or fault of the steam generation heater (pump fault, etc.), water supply to the steam generation container is no longer done, resulting in a larger ratio of OFF-time to ON-time in ON/OFF operation of the steam generation heater. Therefore, when the ratio becomes larger than a predetermined specified value, it is decided by the steam-generation-function decision unit as a halt of the steam generation function including emptiness of water in the water tank. Thus, a halt of the steam generation function including emptiness of water in the water tank can be detected easily with a simple structure.

Therefore, a halt of the steam generation function including emptiness of water in the water tank can be detected with a simple structure without a water level sensor, so that the cost can be cut down. Also, halts of the steam generation function due to factors other than the emptiness of water in the water tank (heater fault, pump fault, etc.) can also be detected.

In one embodiment of the invention, the halt of the steam generation function including emptiness of water in the water tank includes any fault of a pump for supplying the steam generation device with water derived from the water tank.

According to this embodiment, even upon a halt of steam generation by the steam generation device due to fault of the pump for supplying water from the water tank to the steam generation device, a halt of the steam generation function can be detected.

In one embodiment of the invention, the cooking appliance further comprises a heater for heating inside of the heating chamber, wherein in cooking in which the heating chamber supplied with steam derived from the steam generation device is heated by the heater, the steam-generation-function decision unit decides whether or not it is a halt of the steam generation function including emptiness of water in the water tank, based on a ratio of OFF-time to ON-time in ON/OFF operation of the steam generation heater.

According to this embodiment, in cooking in which the heating chamber supplied with steam from the steam generation device is heated by the heater, the steam-generation-function decision unit is enabled to decide whether or not it is a halt of the steam generation function including emptiness of water in the water tank, based on a ratio of OFF-time to ON-time in ON/OFF operation of the steam generation heater.

Advantageous Effects of Invention

As apparent from the above description, according to the cooking appliance of this invention, there can be realized a cooking appliance capable of detecting a halt of the steam generation function including emptiness of water in the water tank with a simple structure and without a water level sensor, and thus cutting down the cost.

BRIEF DESCRIPTION OF DRAWINGS

FIG. 9 is a chart showing a concrete example of the ON-time and OFF-time of the steam generation heater during steam cooking using steam in the cooking appliance.

DESCRIPTION OF EMBODIMENTS

Hereinbelow, a cooking appliance of the present invention will be described in detail by embodiments thereof illustrated in the accompanying drawings.

(First Embodiment)

Figure 1A:
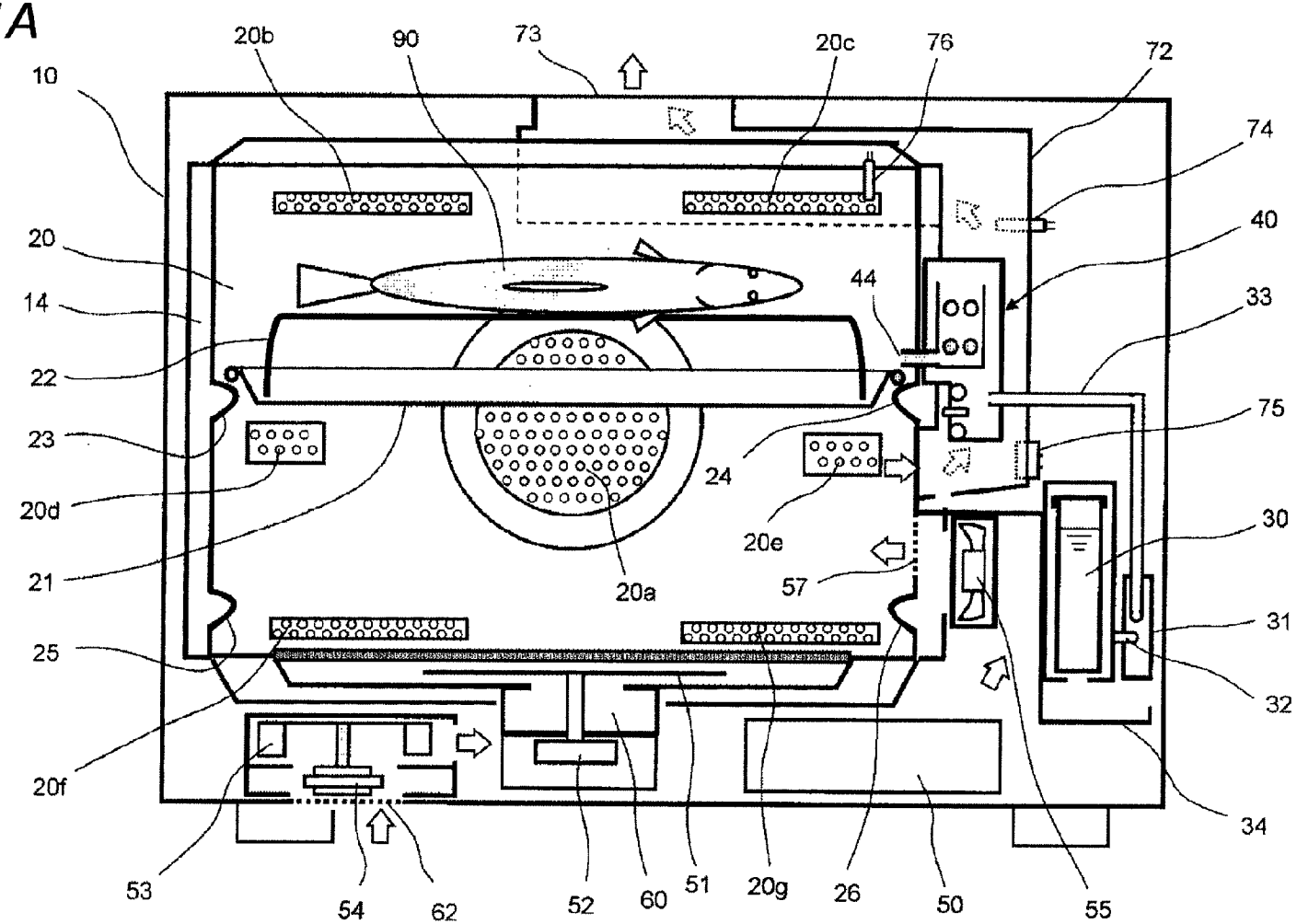
FIG. 1A is a schematic sectional view of a cooking appliance according to a first embodiment of the present invention, as viewed from the front.

FIG. 1A is a schematic sectional view of a cooking appliance according to a first embodiment of the invention, as viewed from the front.

This cooking appliance, as shown in FIG. 1A, has a rectangular parallelopiped-shaped heating chamber 20 provided in a rectangular parallelopiped-shaped main casing 10. The heating chamber 20 has an opening on its front side, and is provided with a heat-shielding plate 14 of stainless steel on its side face, bottom face and top face.

A heat insulating material (not shown) is placed around the heating chamber 20 and inside a door 11 (shown in FIG. 2), so that inside of the heating chamber 20 is thermally insulated from its outside. Also, a square dish 21 made of stainless steel is placed in the heating chamber 20, and a gridiron 22 made of stainless steel wire for placing thereon a cooking object 90, which is to be cooked, is set on the square dish 21.

Upper square dish receivers 23, 24 and lower square dish receivers 25, 26 of an upper-and-lower two-stage structure are provided on both side faces of the heating chamber 20. In FIG. 1A, the square dish 21 is received by the upper square dish receivers 23, 24.

In the main casing 10 and on the right side of the heating chamber 20, the cooking appliance further includes a water tank 30 for supplying water for use of steam generation, a pump 31, and a steam generation device 40 for generating steam by evaporating water supplied from the water tank 30 by the pump 31.

Also, a connecting portion 30*b* (shown in FIG. 2) provided on a lower side of the water tank 30 is connectable to a receiving port 32*a* (shown in FIG. 2) provided at one end of a first water supply pipe 32. The other end of the first water supply pipe 32 is connected to one end of the pump 31. The other end of the pump 31 is connected to one end of a second water supply pipe 33, and the other end of the second water supply pipe 33 is connected to the steam generation device 40.

A circular-shaped suction portion 20*a* is provided at a center of a rear face of the heating chamber 20, and a left-upper blowoff portion 20*b* and a right-upper blowoff portion 20*c* are provided near left-and-right corners, respectively, in the upper side of the rear face of the heating chamber 20. Also, a left-middle blowoff portion 20*d* and a right-middle blowoff portion 20*e* are provided on the left and right, respectively, of the suction portion 20*a* in the rear face of the heating chamber 20, while a left-lower blowoff portion 20*f* and a right-lower blowoff portion 20*g* are provided near the left-and-right corners, respectively, of the lower side of the rear face of the heating chamber 20. An interior temperature sensor 76 for detecting a temperature of an atmosphere in the heating chamber 20 is placed on the right upper side of the heating chamber 20.

A dew turn-back tub 34 is placed below the water tank 30. Further, an electrical-equipment part 50, a cooling fan 53, and a cooling-fan motor 54 for driving the cooling fan 53 are placed below the heating chamber 20 within the main casing 10. The cooling fan 53 cools the electrical-equipment part 50 and the like in the main casing 10 with air sucked through a bottom-side opening 62. Also, an air supply fan 55 for supplying external air into the heating chamber 20 via an inlet port 57 is placed on the right side of the heating chamber 20 within the main casing 10.

A rotating antenna 51 and a rotating-antenna motor 52 for driving the rotating antenna 51 are placed below in the heating chamber 20. Then, microwaves generated by a magnetron 61 (shown in FIG. 2) are led to a lower center of the heating chamber 20 by a waveguide 60, and the microwaves, while being rotated by the rotating antenna 51 that is driven by the rotating-antenna motor 52, are radiated upward into the heating chamber 20, by which the cooking object 90 is heated.

Figure 1B:
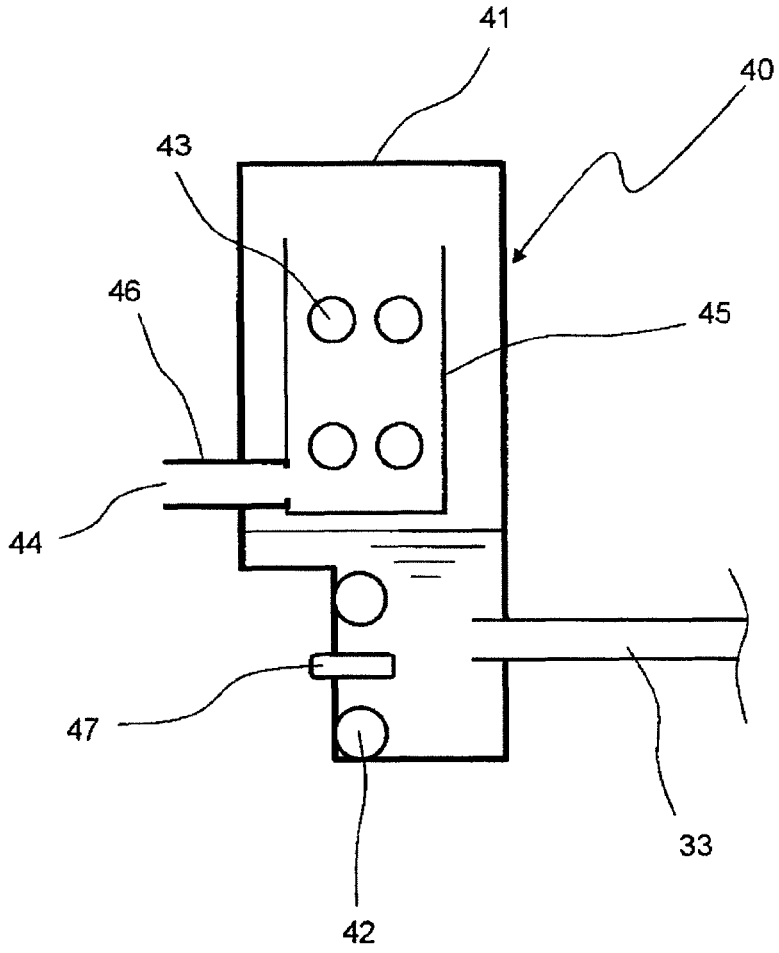
FIG. 1B is an enlarged view of a steam generation device of the cooking appliance.

FIG. 1B is an enlarged view of the steam generation device 40 of the cooking appliance. This steam generation device 40 includes: a steam generation box 41 as an example of a steam generation container to which one end of the second water supply pipe 33 is connected on a lower side; a steam generation heater 42 placed on the lower side within the steam generation box 41; a steam temperature-raising heater 43 placed on an upper side within the steam generation box 41; a steam temperature-raising part 45 which is provided in the steam generation box 41 so as to surround the steam temperature-raising heater 43 with its upper side opened; and a plurality of steam pipes 46 each having one end connected to the lower side of the steam temperature-raising part 45 while a steam blowoff opening 44 of the other end is opened into the heating chamber 20. Water supplied via the second water supply pipe 33 is stored in the lower part of the steam generation box 41, and the stored water is heated by the steam generation heater 42. A steam-generation-box temperature sensor 47 as an example of a steam-generation-container temperature sensor for detecting a temperature of the steam generation box 41 is placed near the steam generation heater 42 in the steam generation box 41.

As shown in FIG. 1A, one end of an exhaust duct 72 as an example of an exhaust passage is connected to an exhaust port 71 (shown in FIG. 2) provided in the right side face of the heating chamber 20, and the other end of the exhaust duct 72 is connected to an outside exhaust port 73. An exhaust temperature sensor 74 is placed as an example of an exhaust passage sensor in the exhaust duct 72, and an exhaust humidity sensor 75 as an example of an exhaust passage sensor is placed on one side closer to the heating chamber 20 than the exhaust temperature sensor 74 in the exhaust duct 72.

Figure 2:
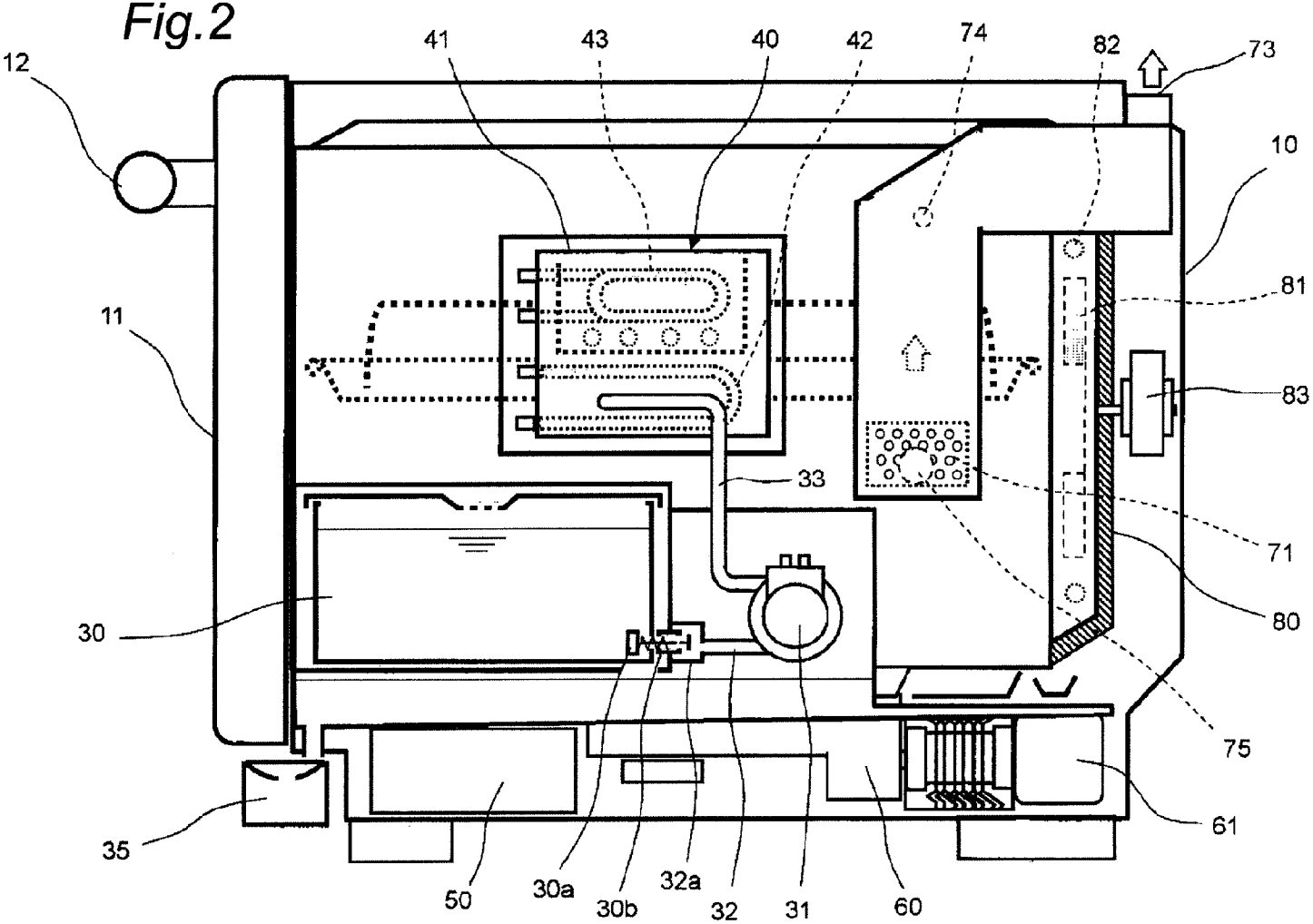
FIG. 2 is a schematic sectional view of the cooking appliance, as viewed from the side.

FIG. 2 is a schematic sectional view of the cooking appliance, as viewed from the side. In FIG. 2, the same component members as in the cooking appliance shown in FIG. 1A are designated by the same reference numerals.

As shown in FIG. 2, the front face of the main casing 10 is formed generally by a door 11 which rotates about a lower side of the front face. Then, a handle 12 is provided at an upper portion of the door 11, and a window (not shown) made of heat-resistant glass is fitted to the door 11.

Further, a convection fan casing 80 is attached on the rear face side of the heating chamber 20, and a convection fan 81 is placed within the convection fan casing 80 while a convection heater 82 as an example of heater is placed so as to surround the convection fan 81. The convection fan 81 is driven by a convection-fan motor 83. Air in the heating chamber 20 is sucked by the convection fan 81 via a suction portion 20*a* shown in FIG. 1A, and heated by the convection heater 82, and thereafter blown off again into the heating chamber 20 through the left-upper blowoff portion 20*b*, the right-upper blowoff portion 20*c*, the left-middle blowoff portion 20*d*, the right-middle blowoff portion 20*e*, the left-lower blowoff portion 20*f*, and the right-lower blowoff portion 20*g* shown in FIG. 1A.

A magnetron 61 is placed below the heating chamber 20. Microwaves generated by the magnetron 61 are led to a lower center of the heating chamber 20 by the waveguide 60.

Figure 3:
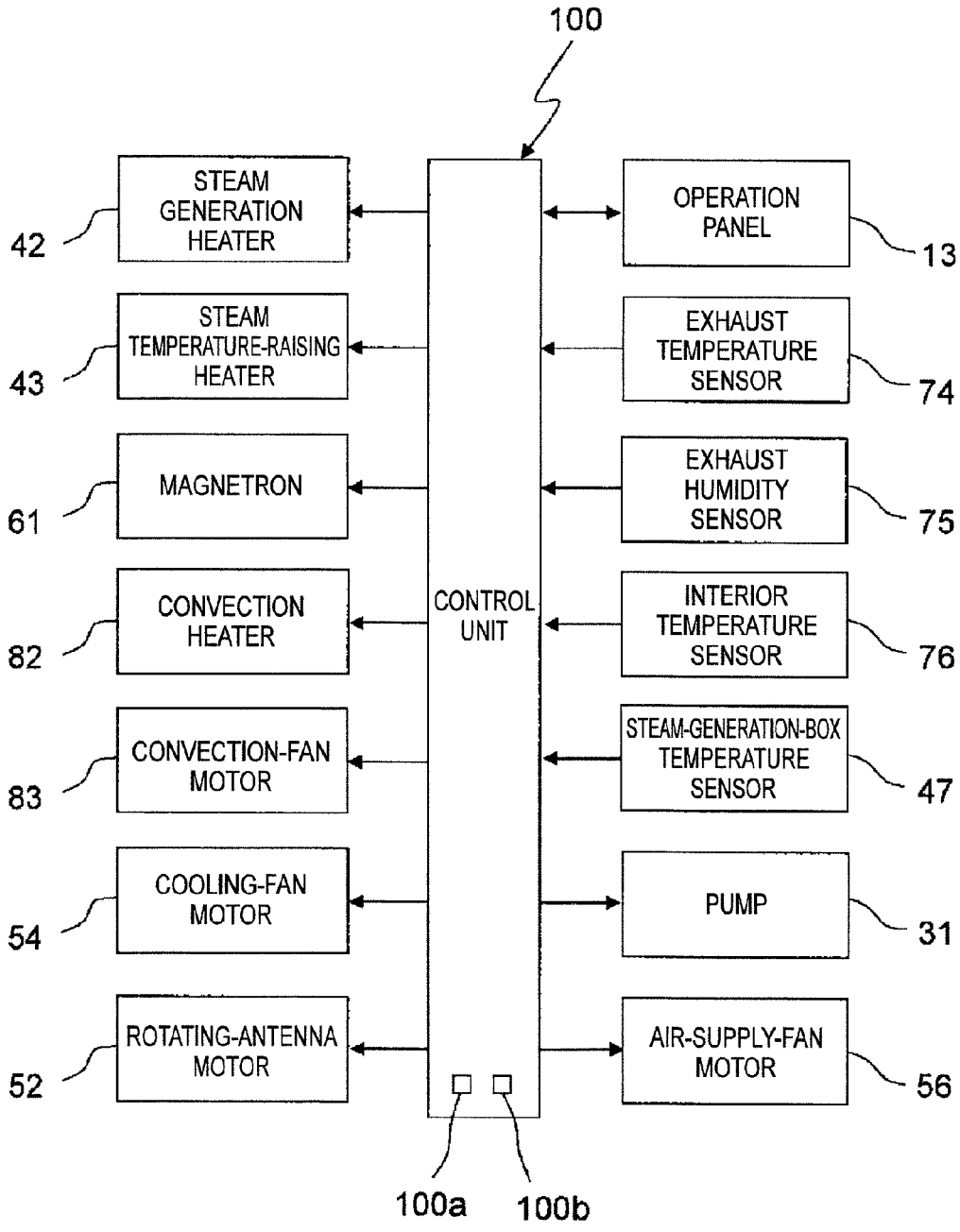
FIG. 3 is a control block diagram of the cooking appliance.

FIG. 3 is a control block diagram of the cooking appliance. As shown in FIG. 3, a control unit 100 is made up of a microcomputer as well as input/output circuits and the like, and placed in the electrical-equipment part 50 shown in FIGS. 1A and 2. This control unit 100 includes a steam-generation-function decision unit 100*a* for deciding whether or not it is a halt of the steam generation function including emptiness of water in the water tank 30, and a heater control unit 100*b* for controlling the steam generation heater 42, the steam temperature-raising heater 43 and the convection heater 82. The heater control unit 100*b* includes a steam-generation-heater control part.

Connected to the control unit 100 are the steam generation heater 42, the steam temperature-raising heater 43, the magnetron 61, the convection heater 82, the convection-fan motor 83, the cooling-fan motor 54, the rotating-antenna motor 52, an operation panel 13, the exhaust temperature sensor 74, the exhaust humidity sensor 75, the interior temperature sensor 76, the steam-generation-box temperature sensor 47, the pump 31, and an air-supply-fan motor 56. Then, based on detection signals from the exhaust temperature sensor 74, the exhaust humidity sensor 75, the interior temperature sensor 76 and the steam-generation-box temperature sensor 47, the control unit 100 controls the steam generation heater 42, the steam temperature-raising heater 43, the magnetron 61, the convection heater 82, the convection-fan motor 83, the cooling-fan motor 54, the rotating-antenna motor 52, the pump 31 and the air-supply-fan motor 56 according to specified programs.

Now, steam heating operation in the above-constructed cooking appliance will be explained with reference to FIGS. 1A, 2 and 3. When a power switch (not shown) of the operation panel 13 is pressed, power is turned on, and operation of oven cooking using superheated steam is started by operation of the operation panel 13. Then, first, by a water tank detection part (not shown), the control unit 100 detects whether or not the water tank is correctly set, where if the water tank 30 is correctly set, operation of the pump 31 is started. Then, by the pump 31, water is supplied from the water tank 30 via the second water supply pipe 33 into the steam generation box 41 of the steam generation device 40. Thereafter, with a specified quantity of water supplied into the steam generation box 41, the pump 31 is stopped so that the water supply is stopped.

Next, the steam generation heater 42 is turned on, so that the specified quantity of water stored in the steam generation box 41 is heated by the steam generation heater 42. Then, in synchronization with the turn-on of the steam generation heater 42, or when the temperature of the steam generation box 41 detected by the steam-generation-box temperature sensor 47 has reached a specified temperature, the convection fan 81 is driven by the convection-fan motor 83 while the convection heater 82 is turned on. Then, the convection fan 81 sucks gas (including steam) in the heating chamber 20 through the suction portion 20*a* to feed the gas (including steam) heated by the convection heater 82 into the heating chamber 20.

Next, boiling of water in the steam generation box 41 of the steam generation device 40 causes saturated steam to be generated, and the generated saturated steam is heated by the steam temperature-raising heater 43 in the steam temperature-raising part 45, resulting in superheated steam of 100° C. or higher (temperature differs depending on cooking contents), which is supplied from the steam blowoff opening 44 via the steam pipes 46 into the heating chamber 20.

This superheated steam is sucked together with air in the heating chamber 20 through the suction portion 20*a* by the convection fan 81, and heated by the convection heater 82, blown into the heating chamber 20 through the left-upper blowoff portion 20*b*, the right-upper blowoff portion 20*c*, the left-middle blowoff portion 20*d*, the right-middle blowoff portion 20*e*, the left-lower blowoff portion 20*f* and the right-lower blowoff portion 20*g*, so that such a convection as to wrap the cooking object 90 in the heating chamber 20 is formed. Then, flows of convective steam are sucked in succession to the suction portion 20*a*, passing through the convection fan casing 80 and returning again into the heating chamber 20 repeatedly in circulation.

As shown above, by the formation of convection of superheated steam in the heating chamber 20, it becomes possible to make superheated steam efficiently collide with the cooking object 90 placed on the gridiron 22 while maintaining uniform temperature and humidity distributions in the heating chamber 20, where the cooking object 90 is heated by the collisions of the superheated steam. In this case, superheated steam brought into contact with a surface of the cooking object 90 makes the cooking object 90 heated also by releasing latent heat upon condensation at the surface of the cooking object 90. As a result, large quantity of heat of superheated steam can be given uniformly to all over the cooking object 90 reliably and promptly. Therefore, cooking of good finish and uniformity can be achieved.

Also, during the cooking operation shown above, as time elapses, the quantity of steam in the heating chamber 20 increases, so that quantitatively excessive steam is released from the exhaust port 71 via the exhaust duct 72 so as to go outside from the outside exhaust port 73.

After cooking completion, a message of cooking completion is displayed on the operation panel 13 by the control unit 100, and a signal sound is generated by a buzzer (not shown) provided on the operation panel 13.

The above description is directed to a case of oven cooking using superheated steam. In addition, in a case of steam cooking using steam, the same operation as described above is performed without driving the convection fan 81 and without turning on the convection heater 82.

In contrast to this, for microwave heating operation, when the operation panel 13 is operated by a user so that a microwave cooking menu is decided and a start key (not shown) is pressed, operation of the microwave heating cooking is started. Then, the control unit 100 drives the magnetron 61 so that microwaves are fed to the cooking object 90 via the waveguide 60 and the rotating antenna 51 to heat the cooking object 90. In addition, for this case, a microwave-transmitting nonmetal catch pan on which the cooking object 90 is mounted is laid on a bottom plate of the heating chamber 20 as an example.

Figure 4:
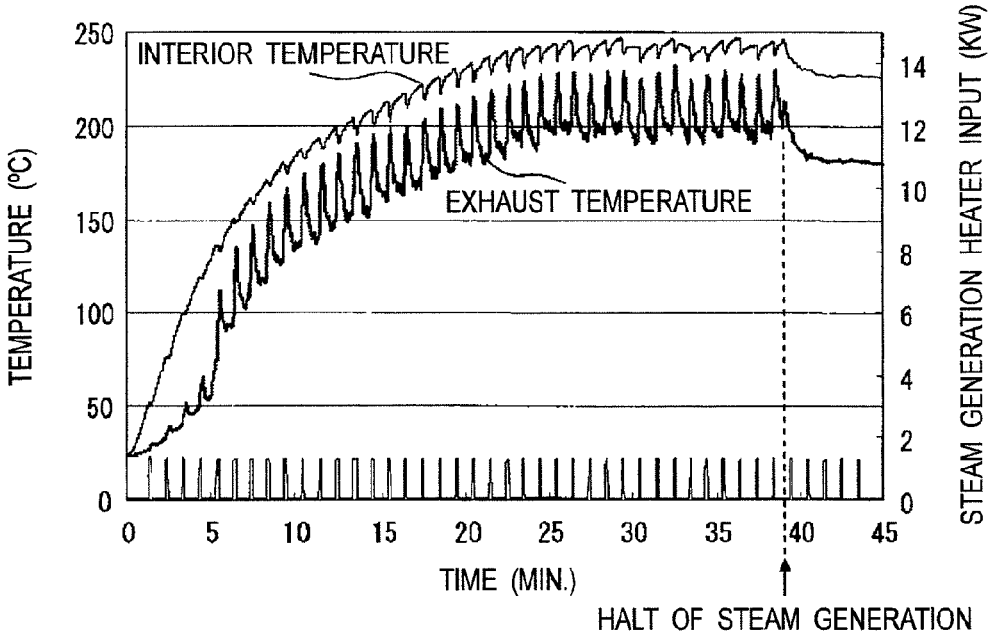
FIG. 4 is a chart showing variations in interior temperature and exhaust temperature in response to turn-on and -off of a steam generation heater during oven cooking using superheated steam in the cooking appliance.

FIG. 4 is a chart showing variations in interior temperature and exhaust temperature in response to turn-on and -off of the steam generation heater 42 during oven cooking using superheated steam in the cooking appliance. In FIG. 4, the horizontal axis represents time (minute) and the vertical axis represents temperature (° C.) and steam generation heater input (kW).

In this first embodiment, during oven cooking using superheated steam (interior temperature setting: 250° C.), as shown in FIG. 4, the steam generation heater 42 is turned on and off repetitively, i.e., turned on for 10 seconds per minute during 15 minutes from the start and turned on for 7 seconds per minute after the 15 minute elapse.

In this case, the interior temperature detected by the interior temperature sensor 76 and the exhaust temperature detected by the exhaust temperature sensor 74 gradually increase to near 250° C. Turn-on of the steam generation heater 42 causes the interior temperature and the exhaust temperature to change higher, while turn-off of the steam generation heater 42 causes the interior temperature and the exhaust temperature to change lower. That is, the interior temperature and the exhaust temperature periodically change high and low depending on turn-on and -off of the steam generation heater 42.

Then, upon a halt of the steam generation function due to emptiness of water in the water tank 30 or fault of the steam generation heater 42 or fault of the pump 31 or the like, the interior temperature detected by the interior temperature sensor 76 and the exhaust temperature detected by the exhaust temperature sensor 74 show almost no periodical changes any more as shown in FIG. 4.

Figure 5:
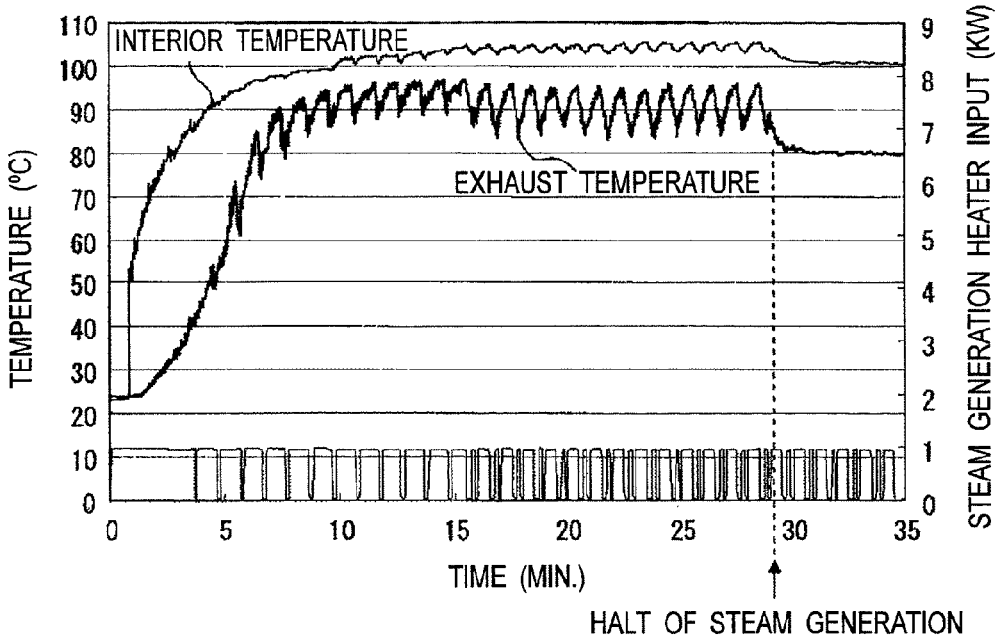
FIG. 5 is a chart showing variations in interior temperature and exhaust temperature in response to turn-on and -off of the steam generation heater during steam cooking using steam in the cooking appliance.

FIG. 5 is a chart showing variations in interior temperature and exhaust temperature in response to turn-on and -off of the steam generation heater during steam cooking using steam in the cooking appliance. In FIG. 5, the horizontal axis represents time (minute) and the vertical axis represents temperature (° C.) and steam generation heater input (kW).

During steam cooking using steam, as shown in FIG. 5, the steam generation heater 42 is turned on and off repetitively, i.e., turned on continuously during 4 minutes from the start, turned on for 50 seconds per minute after the 4 minute elapse and until a 15 minute elapse, and turned on for 40 seconds per minute after the 15 minute elapse.

In this case, the interior temperature detected by the interior temperature sensor 76 and the exhaust temperature detected by the exhaust temperature sensor 74 increase to near 100° C. in several seconds. Turn-on of the steam generation heater 42 causes the interior temperature and the exhaust temperature to change higher, while turn-off of the steam generation heater 42 causes the interior temperature and the exhaust temperature to change lower. That is, the interior temperature and the exhaust temperature periodically change high and low depending on turn-on and -off of the steam generation heater 42.

Then, upon a halt of the steam generation function due to emptiness of water in the water tank 30 or fault of the steam generation heater 42 or fault of the pump 31 or the like, the interior temperature detected by the interior temperature sensor 76 and the exhaust temperature detected by the exhaust temperature sensor 74 show almost no periodical changes any more as shown in FIG. 5.

According to the cooking appliance of the above construction, upon cooking (e.g. oven cooking, steam cooking, etc.) using steam supplied into the heating chamber 20, the steam generation device 40 supplies steam to the heating chamber 20. Then, during the cooking, steam from the steam generation device 40 keeps being supplied to the heating chamber 20, so that atmosphere including steam in the heating chamber 20 is discharged little by little to outside of the main casing 10 via the exhaust duct 72. In this case, upon a halt of steam generation by the steam generation device 40 due to emptiness of water in the water tank 30 or fault of the steam generation device 40 (heater fault, pump fault, etc.), steam is no longer supplied to the heating chamber 20, so that the exhaust via the exhaust duct 72 almost stops, thus resulting in variation in exhaust temperature of the atmosphere in the exhaust duct 72, which is a physical quantity correlating to the presence or absence of water in the steam generation box 41, becoming small. By utilizing such characteristics, the steam-generation-function decision unit 100*a*, based on an exhaust temperature detected by the exhaust temperature sensor 74, decides whether or not it is a halt of the steam generation function including emptiness of water in the water tank 30. Therefore, a halt of the steam generation function including emptiness of water in the water tank 30 can be detected with a simple structure without a water level sensor, so that the cost can be cut down. Also, halts of the steam generation function due to factors other than the emptiness of water in the water tank 30 (heater fault, pump fault, etc.) can also be detected.

In this first embodiment, in cooking in which steam from the steam generation device 40 is supplied into the heating chamber 20, upon a halt of steam generation by the steam generation device 40 due to emptiness of water in the water tank 30 or fault of the steam generation device 40 (fault of the steam generation heater 42, fault of pump 31, etc.), when the exhaust temperature detected by the exhaust temperature sensor 74 does not periodically change high or low even with turn-on and -off of the steam generation heater 42 by the heater control unit 100*b*, it is decided by the steam-generation-function decision unit 100*a* as a halt of the steam generation function including the emptiness of water in the water tank 30. By utilizing this characteristic of the exhaust temperature of the atmosphere in the exhaust duct 72 linked with turn-on and -off of the steam generation heater 42, a halt of the steam generation function including the emptiness of water in the water tank 30 can be detected more reliably.

In addition, another way of decision is also possible; that is, upon a halt of steam generation by the steam generation device 40 due to emptiness of water in the water tank or fault of the steam generation device 40 (fault of the steam generation heater 42, fault of the pump 31, etc.), when the exhaust temperature detected by the exhaust temperature sensor 74 does not change higher in response to turn-on of the steam generation heater 42, it is decided by the steam-generation-function decision unit 100*a* as a halt of the steam generation function including emptiness of water in the water tank 30. In this case also, by utilizing the characteristic of the exhaust temperature of the atmosphere in the exhaust duct 72 linked with turn-on of the steam generation heater 42, a halt of the steam generation function including the emptiness of water in the water tank 30 can be detected reliably.

Further, in the first embodiment, a halt of the steam generation function can be detected also upon a halt of steam generation by the steam generation device 40 due to fault of the steam generation heater 42 of the steam generation device 40. Moreover, a halt of the steam generation function can be detected even when the steam generation by the steam generation device 40 is stopped due to fault of the pump 31 for supplying the steam generation device 40 with water from the water tank 30.

As shown above, according to the cooking appliance of the first embodiment, in oven cooking in which the heating chamber 20 supplied with steam from the steam generation device 40 is internally heated by the convection heater 82 or steam cooking using steam, the steam-generation-function decision unit 100*a*, based on an exhaust temperature detected by the exhaust temperature sensor 74, can decide whether or not it is a halt of the steam generation function including emptiness of water in the water tank 30.

(Second Embodiment)

Figure 6:
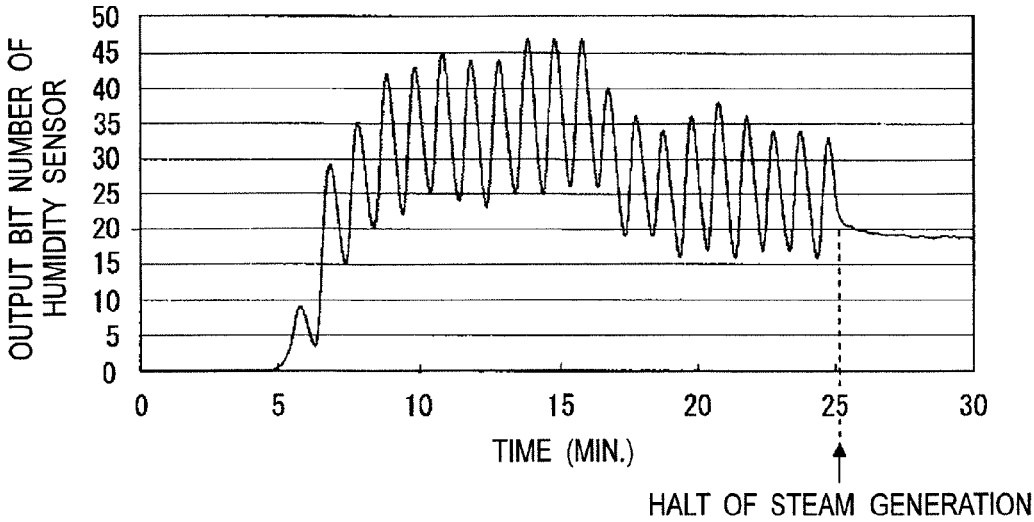
FIG. 6 is a chart showing variations in output bit number of an exhaust humidity sensor in response to turn-on and -off of the steam generation heater during oven cooking using superheated steam in a cooking appliance according to a second embodiment of the invention.

FIG. 6 is a chart showing variations in output bit number of the exhaust humidity sensor 75 in response to turn-on and -off of the steam generation heater 42 during oven cooking using superheated steam in a cooking appliance according to a second embodiment of the invention. The cooking appliance of the second embodiment is similar in construction to the cooking appliance of the first embodiment except operation of the control unit 100, and therefore FIGS. 1A, 1B and 2 are referenced also in this case.

In FIG. 6, the horizontal axis represents time (minute) and the vertical axis represents output bit number of the exhaust humidity sensor 75. In this second embodiment, an output bit number of zero of the exhaust humidity sensor 75 represents an absolute humidity of the indoor air level, and larger bit numbers represent increases in absolute humidity with increased moisture in the exhaust.

In this cooking appliance of the second embodiment, in oven cooking using superheated steam (interior temperature setting: 200° C.), as shown in FIG. 6, the steam generation heater 42 is turned on and off repetitively, i.e., turned on for 12 seconds per minute during 15 minutes from the start and turned on for 9 seconds per minute after the 15 minute elapse.

In this case, an exhaust humidity detected by the exhaust humidity sensor 75 gradually increases. Turn-on of the steam generation heater 42 causes the exhaust humidity to change higher, while turn-off of the steam generation heater 42 causes the exhaust humidity to change lower. That is, the exhaust humidity periodically changes high and low depending on turn-on and -off of the steam generation heater 42.

Then, upon a halt of the steam generation function due to emptiness of water in the water tank 30 or fault of the steam generation heater 42 or fault of the pump 31 or the like, the exhaust humidity detected by the exhaust humidity sensor 75 shows almost no periodical changes any more as shown in FIG. 6.

Figure 7:
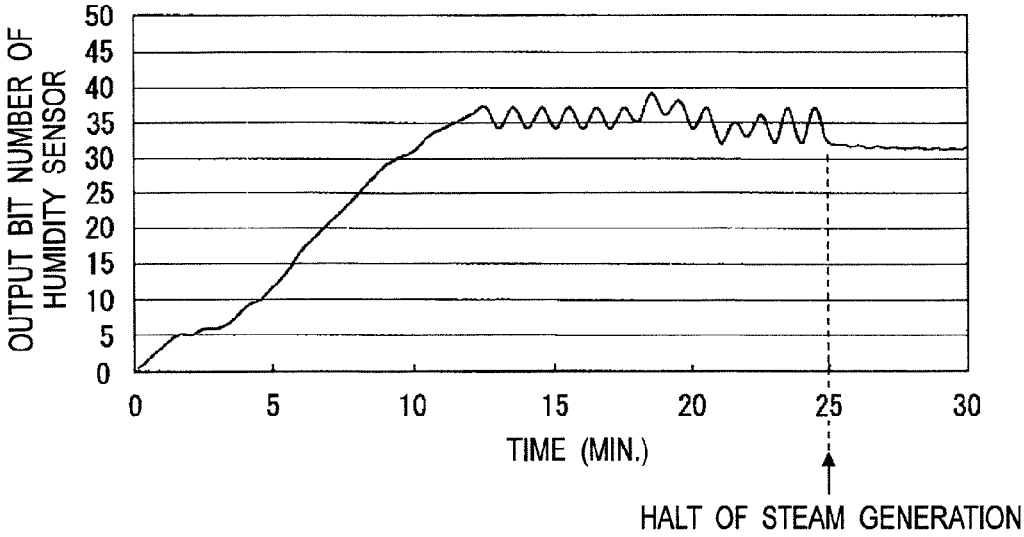
FIG. 7 is a chart showing variations in output bit number of an exhaust humidity sensor in response to turn-on and -off of the steam generation heater during steam cooking using steam in the cooking appliance.

FIG. 7 is a chart showing variations in output bit number of the exhaust humidity sensor 75 in response to turn-on and -off of the steam generation heater during steam cooking using steam in the cooking appliance.

During steam cooking using steam, as shown in FIG. 7, the steam generation heater 42 is turned on and off repetitively, i.e., turned on continuously during 4 minutes from the start, turned on for 50 seconds per minute after the 4 minute elapse and until a 15 minute elapse, and turned on for 40 seconds per minute after the 15 minute elapse.

In this case, the exhaust humidity detected by the exhaust humidity sensor 75 gradually increases. Turn-on of the steam generation heater 42 causes the exhaust humidity to change higher, while turn-off of the steam generation heater 42 causes the exhaust humidity to change lower. That is, the exhaust humidity periodically changes high and low depending on turn-on and -off of the steam generation heater 42.

Then, upon a halt of the steam generation function due to emptiness of water in the water tank 30 or fault of the steam generation heater 42 or fault of the pump 31 or the like, the exhaust humidity detected by the exhaust humidity sensor 75 shows almost no periodical changes any more as shown in FIG. 7.

According to the cooking appliance of the above construction, the steam-generation-function decision unit 100*a*, based on an exhaust humidity detected by the exhaust humidity sensor 75, which is a physical quantity correlating to the presence or absence of water in the steam generation box 41, decides whether or not it is a halt of the steam generation function including emptiness of water in the water tank 30. Therefore, a halt of the steam generation function including the emptiness of water in the water tank 30 can be detected with a simple structure without a water level sensor, so that the cost can be cut down. Also, halts of the steam generation function due to factors other than the emptiness of water in the water tank 30 (heater fault, pump fault, etc.) can also be detected.

In this second embodiment, upon a halt of steam generation by the steam generation device 40 due to emptiness of water in the water tank 30 or fault of the steam generation device 40 (fault of the steam generation heater 42, fault of pump 31, etc.), since the exhaust humidity detected by the exhaust humidity sensor 75 does not periodically change high or low even with turn-on and -off of the steam generation heater 42 by the heater control unit 100*b*, it is decided by the steam-generation-function decision unit 100*a* as a halt of the steam generation function including the emptiness of water in the water tank 30. By utilizing this characteristic of the exhaust humidity of the atmosphere in the exhaust duct 72 linked with turn-on and -off of the steam generation heater 42, a halt of the steam generation function including the emptiness of water in the water tank 30 can be detected more reliably.

In addition, another way of decision is also possible; that is, upon a halt of steam generation by the steam generation device 40 due to emptiness of water in the water tank or fault of the steam generation device 40 (fault of the steam generation heater 42, fault of the pump 31, etc.), since the exhaust humidity detected by the exhaust humidity sensor 75 does not change higher in response to turn-on of the steam generation heater 42, it is decided by the steam-generation-function decision unit 100*a* as a halt of the steam generation function including emptiness of water in the water tank 30. In this case also, by utilizing the characteristic of the exhaust humidity of the atmosphere in the exhaust duct 72 linked with turn-on of the steam generation heater 42, a halt of the steam generation function including the emptiness of water in the water tank 30 can be detected reliably.

Further, a halt of the steam generation function can be detected also upon a halt of steam generation by the steam generation device 40 due to fault of the steam generation heater 42 of the steam generation device 40. Moreover, a halt of the steam generation function can be detected even when the steam generation by the steam generation device 40 is stopped due to fault of the pump 31 for supplying water in the water tank 30 to the steam generation device 40.

As shown above, according to the cooking appliance of the second embodiment, even in oven cooking in which the heating chamber 20 supplied with steam from the steam generation device 40 is internally heated by the convection heater 82, the steam-generation-function decision unit 100*a*, based on an exhaust humidity detected by the exhaust humidity sensor 75, can decide whether or not it is a halt of the steam generation function including emptiness of water in the water tank 30.

(Third Embodiment)

A cooking appliance according to a third embodiment of the invention is described below. The cooking appliance of the third embodiment is similar in construction to the cooking appliance of the first embodiment except operation of the control unit 100, and therefore FIGS. 1A, 1B and 2 are referenced also in this case.

In steam cooking using steam in the cooking appliance of the third embodiment, the heater control unit 100*b* of the control unit 100 turns off the steam generation heater 42 when the temperature of the steam generation box 41 detected by the steam-generation-box temperature sensor 47 has exceeded an upper-limit temperature (e.g., 120° C.), and turns on the steam generation heater 42 when the temperature of the steam generation box 41 has lowered below a lower-limit temperature (e.g., 105° C.) in off state of the steam generation heater 42. It is noted that the upper-limit temperature and the lower-limit temperature may be set as appropriate depending on the construction of the steam generation device or the like.

This cooking appliance has a first operation mode in which the steam generation heater 42 is operated by temperature control based on the temperature of the steam generation box 41 for a specified time duration (e.g., 15 minutes) from start of steam cooking using steam, and a second operation mode in which, after elapse of the specified time duration, heater is controlled by alternate repetition of an on-enabled period and an off period of the steam generation heater 42 at a duty ratio corresponding to a desired heater output. In this second operation mode, in the on-enabled period, the steam generation heater 42 is operated by the temperature control based on the temperature of the steam generation box 41. The pump 31 is operated in continuous operation in the first operation mode, and the pump 31 is operated only during the on-enabled period in the second operation mode.

In such steam cooking using steam, the steam-generation-function decision unit 100*a* of the control unit 100 measures after starting operation ON-time of the steam generation heater 42 and subsequent OFF-time so as to decide whether ON-time<OFF-time. That is, it is decided whether or not a ratio of OFF-time to ON-time exceeds 1.

In the decision by the steam-generation-function decision unit 100*a*, upon two consecutive satisfactions of the relationship that ON-time<OFF-time, a message "WATER" is displayed in blink on the operation panel 13 by the control unit 100. It is noted that, in some cases, since water is not supplied into the steam generation box 41 soon after operation of the pump 31, a first-time decision by means of ON-time and OFF-time is neglected.

Then, upon five-time consecutive satisfactions of the relationship that ON-time<OFF-time, the steam-generation-function decision unit 100*a* decides as an emptiness of water, and the heater control unit 100*b* of the control unit 100 halt the heating by the steam generation heater 42. It is noted here that the number of times for decision is not limited to five, but is changeable into values stored in EEPROM (Electrically Erasable Programmable Read-Only Memory) or the like.

In addition, after elapse of a specified duration (e.g., 5 minutes) from an operation start, heating by the steam generation heater 42 is continued without performing measurement and decision of the ON-time and the OFF-time.

Also, in oven cooking or grill cooking using superheated steam, the decision as to an emptiness of water using the ratio of OFF-time to ON-time of the steam generation heater 42 is not performed.

Figure 8:
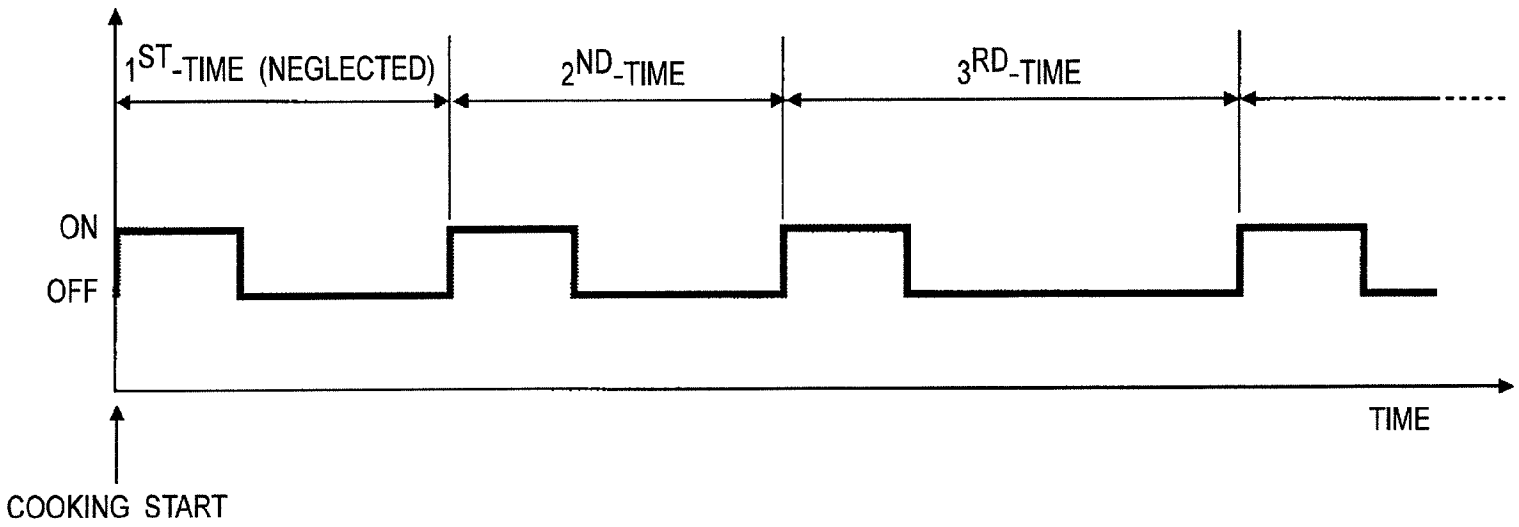
FIG. 8 is a chart showing variations in ON-time and OFF-time of the steam generation heater during steam cooking using steam in a cooking appliance according to a third embodiment of the invention.

FIG. 8 shows variations in ON-time and OFF-time of the steam generation heater 42 during steam cooking using steam in the cooking appliance.

Also, FIG. 9 shows data of a concrete example of the ON-time and OFF-time of the steam generation heater 42 during steam cooking using steam in the cooking appliance.

FIG. 9 shows ON-time and OFF-time of the steam generation heater in cases of supply water present (1) and supply water absent (2) under a condition that the steam generation box 41 has been cooled with no water present in the steam generation box 41 at a start of steam cooking using steam, and moreover shows ON-time and OFF-time of the steam generation heater 42 in a case of supply water absent (3) under a condition that the steam generation box 41 has been warmed with supply water present in the steam generation box 41 at a start of steam cooking using steam.

In FIG. 9, elapsed time from the start of steam cooking using steam is expressed in a "minute-second" unit and a "second" unit, while shown on the right side are ON-time and OFF-time of the steam generation heater 42. It is noted here that upon two consecutive satisfactions of the relationship that ON-time<OFF-time, a message "WATER" is displayed in blink on the operation panel 13 by the control unit 100.

In column (1) of FIG. 9, the relationship that ON-time<OFF-time is satisfied only at the second time of ON/OFF operation, and the relationship that ON-time<OFF-time is not satisfied at the first-time and three to fifth times, so that the blinking of the message "WATER" and a decision of water emptiness are not performed. Then, at the sixth time of the ON/OFF operation, the cooking is completed. Since this sixth-time ON/OFF operation is over the specified time elapse of 5 minutes, the decision of water emptiness by the steam-generation-function decision unit 100*a* is not performed.

Also, in column (2) of FIG. 9, the relationship that ON-time<OFF-time is satisfied consecutively two times at the second- and third-time of ON/OFF operation, so that the message "WATER" is displayed in blink on the operation panel 13 by the control unit 100. Then, the relationship that ON-time<OFF-time is satisfied consecutively five times at the second to sixth times of ON/OFF operation, so that the steam-generation-function decision unit 100*a* makes a decision of water emptiness, where the heater control unit 100*b* of the control unit 100 halts the heating by the steam generation heater 42.

In column (3) of FIG. 9, the steam generation box 41 has been warmed higher in temperature than in column (2) of FIG. 9. However, since water is present in the steam generation box 41, the ON-time of the first-time ON/OFF operation is longer than the ON-time of the first time of column (2) of FIG. 9 (column (2) ON-time, 37 seconds<column (3) ON-time, 49 seconds). The relationship that ON-time<OFF-time is satisfied consecutively two times at the succeeding second and third times of ON/OFF operation, so that the message "WATER" is displayed in blink on the operation panel 13 by the control unit 100. Then, the relationship that ON-time<OFF-time is satisfied consecutively five times at the second to sixth times of ON/OFF operation, so that the steam-generation-function decision unit 100*a* makes a decision of water emptiness, where the heater control unit 100*b* of the control unit 100 halts the heating by the steam generation heater 42.

According to the cooking appliance of the above construction, in steam cooking in which steam from the steam generation device 40 is supplied into the heating chamber 20, based on information as to a physical quantity indirectly representing the presence or absence of water in the steam generation device 40 (a ratio of OFF-time to ON-time in ON/OFF operation of the steam generation heater 42), the steam-generation-function decision unit decides whether or not it is a halt of the steam generation function including emptiness of water in the water tank 30. Therefore, a halt of the steam generation function including emptiness of water in the water tank 30 can be detected with a simple structure without a water level sensor, so that the cost can be cut down. Also, halts of the steam generation function due to factors other than the emptiness of water in the water tank (heater fault, pump fault, etc.) can also be detected.

Moreover, when steam generation by the steam generation device 40 is stopped due to emptiness of water in the water tank 30 or fault of the steam generation device 40 (heater fault, pump fault, etc.), water supply to the steam generation box 41 is no longer done, resulting in a larger ratio of OFF-time to ON-time in ON/OFF operation of the steam generation heater 42. Therefore, when the ratio of OFF-time to ON-time becomes larger than a predetermined specified value ("1" in this third embodiment), it is decided by the steam-generation-function decision unit 100*a* as a halt of the steam generation function including emptiness of water in the water tank 30. Thus, a halt of the steam generation function including emptiness of water in the water tank 30 can be detected easily with a simple structure.

In addition, the specified value for deciding the ratio of OFF-time to ON-time is set to "1" in this third embodiment. However, the value may be set as appropriate depending on the construction of the steam generation device or the like.

Although specific embodiments of the present invention have been fully described hereinabove, the invention is not limited to the above embodiments and may be carried out with various changes and modifications within the scope of the invention.

REFERENCE SIGNS LIST

10 main casing
11 door
12 handle
13 operation panel
14 heat-shielding plate
20 heating chamber
20*a* suction portion
20*b* left-upper blowoff portion
20*c* right-upper blowoff portion
20*d* left-middle blowoff portion
20*e* right-middle blowoff portion
20*f* left-lower blowoff portion
20*g* right-lower blowoff portion
21 square dish
22 gridiron
23, 24 upper square dish receiver
25, 26 lower square dish receiver
30 water tank
31 pump
32 first water supply pipe
33 second water supply pipe
34 dew turn-back tub
40 steam generation device
41 steam generation box
42 steam generation heater
43 steam temperature-raising heater
45 steam temperature-raising part
44 steam blowoff opening
46 steam pipes
47 steam-generation-box temperature sensor
50 electrical-equipment part
51 rotating antenna
52 rotating-antenna motor
53 cooling fan
54 cooling-fan motor
55 air supply fan
56 air-supply-fan motor
57 inlet port
60 waveguide
61 magnetron
71 exhaust port
72 exhaust duct
73 outside exhaust port
74 exhaust temperature sensor
75 exhaust humidity sensor
76 interior temperature sensor
80 convection fan casing
81 convection fan
82 convection heater
83 convection-fan motor
90 cooking object
100 control unit
100*a* steam-generation-function decision unit
100*b* heater control unit

The invention claimed is:

1. A cooking appliance comprising:

a main casing;

a water tank placed within the main casing;

a steam generation device which has a steam generation container supplied with water from the water tank, and a steam generation heater for heating water in the steam generation container, and which serves for heating water supplied from the water tank to generate steam;

a heating chamber to which steam from the steam generation device is supplied;

a steam-generation-container temperature sensor for detecting a temperature of the steam generation container;

a steam-generation-heater control part which, in cooking in which steam from the steam generation device is supplied into the heating chamber, with supply of water from the water tank to the steam generation container, repeats turn-on and -off of the steam generation heater while there is water in the steam generation container by controlling the steam generation heater so that a temperature of the steam generation container detected by the steam-generation-container temperature sensor falls within a target temperature range; and a steam-generation-function decision unit for, based on a ratio of OFF-time to ON-time in ON/OFF operation of the steam generation heater, deciding whether or not it is a halt of steam generation function including emptiness of water in the water tank, in cooking in which steam from the steam generation device is supplied into the heating chamber, wherein when the ratio of OFF-time to ON-time in ON/OFF operation of the steam generation heater is larger than a specified value, the steam-generation-function decision unit decides that it is a halt of the steam generation function including emptiness of water in the water tank.

2. The cooking appliance as claimed in claim 1, wherein the halt of the steam generation function including emptiness of water in the water tank includes any fault of a pump for supplying the steam generation device with water derived from the water tank.

3. The cooking appliance as claimed in claim 1, further comprising a heater for heating inside of the heating chamber, wherein in cooking in which the heating chamber supplied with steam derived from the steam generation device is heated by the heater, the steam-generation-function decision unit decides whether or not it is a halt of the steam generation function including emptiness of water in the water tank, based on a ratio of OFF-time to ON-time in ON/OFF operation of the steam generation heater.

4. The cooking appliance as claimed in claim 2, further comprising a heater for heating inside of the heating chamber, wherein in cooking in which the heating chamber supplied with steam derived from the steam generation device is heated by the heater, the steam-generation-function decision unit decides whether or not it is a halt of the steam generation function including emptiness of water in the water tank, based on a ratio of OFF-time to ON-time in ON/OFF operation of the steam generation heater.

* * * * *